US005658479A

United States Patent [19]

Tadokoro

[11] Patent Number: 5,658,479

[45] Date of Patent: Aug. 19, 1997

[54] POSITIVE TEMPERATURE COEFFICIENT THERMISTOR HEATER AND POSITIVE TEMPERATURE COEFFICIENT THERMISTOR HEATER DEVICE USING THE SAME

[75] Inventor: Tomoaki Tadokoro, Kyoto, Japan

[73] Assignee: Murata Manufacturing Co., Ltd., Japan

[21] Appl. No.: 347,287

[22] Filed: Nov. 30, 1994

[30] Foreign Application Priority Data

Nov. 30, 1993 [JP] Japan ..... 5-300118

[51] Int. Cl.[6] ..... H05B 1/02

[52] U.S. Cl. ..... 219/505; 219/508; 219/483; 219/486; 338/201; 338/325; 338/22 R

[58] Field of Search ..... 219/504, 505, 219/507–509, 494, 446, 483, 486; 338/201, 325, 222, 23, 24, 25, 200, 22 R

[56] References Cited

U.S. PATENT DOCUMENTS

| | | | |
|---|---|---|---|
| 1,832,532 | 11/1931 | Church | 219/505 |
| 2,075,733 | 3/1937 | Lazarus | 201/76 |
| 3,691,503 | 9/1972 | Battle et al. | 338/95 |
| 4,151,401 | 4/1979 | Van Bokest et al. | 219/508 |
| 4,814,584 | 3/1989 | Bohlender et al. | 219/535 |
| 4,841,127 | 6/1989 | Prager et al. | 219/225 |

FOREIGN PATENT DOCUMENTS

| | | |
|---|---|---|
| 4-251901 | 9/1992 | Japan . |

*Primary Examiner*—Mark H. Paschall
*Attorney, Agent, or Firm*—Ostrolenk, Faber, Gerb & Soffen, LLP

[57] ABSTRACT

The positive temperature coefficient thermistor heater is composed of a positive temperature coefficient thermistor element, and electrodes formed on the both principal faces of the thermistor element. At least one of the electrodes consists of split electrodes. The positive temperature coefficient thermistor heater device has a positive temperature coefficient thermistor heater in which at least one of the electrodes consists of split electrodes, and radiator plates disposed on the both principal faces of the thermistor element. The split electrodes of the positive temperature coefficient thermistor heater are equal in area to each other, or different from each other.

30 Claims, 3 Drawing Sheets

POSITIVE TEMPERATURE COEFFICIENT THERMISTOR HEATER AND POSITIVE TEMPERATURE COEFFICIENT THERMISTOR HEATER DEVICE USING THE SAME

BACKGROUND OF THE INVENTION

1. Field of the Invention

The present invention relates to a positive temperature coefficient thermistor heater and a positive temperature coefficient thermistor heater device which are useful as a heater, etc. for generating hot air in a heater, a dryer and so on.

2. Description of the Related Art

Recently, a positive temperature coefficient (hereinafter, often abbreviated as "PTC") thermistor heater has become widely used as a heating element of a hot air type heater, a bedclothes dryer, a hair dryer or the like. A PTC thermistor heater has a positive temperature characteristic. When such a thermistor heater is self-heated to a temperature higher than a certain level, a resistance therein is increased and the thermistor heater exhibits a self-regulating property so as to be kept at the temperature. For example, a hot air type heater utilizes this property. Specifically, such a heater has a PTC thermistor heater device in which a radiator plate is in thermal contact with plural PTC thermistor heaters which are electrically connected to each other. When the temperature of hot air generated by the hot air type heater is to be changed, the output of the PTC thermistor heater device is changed by increasing or decreasing the number of PTC thermistor heaters to be energized.

A conventional PTC thermistor heater will be described with reference to FIG. 1. A PTC thermistor heater device 60 comprises PTC thermistor heaters 61, radiator plates 62, and a first terminal 63 and second terminals 64 which are conductor terminals.

Each of the PTC thermistor heaters 61 is configured by forming electrodes (not shown) on both principal faces of a substantially rectangular plate-like PTC thermistor element. Each of the radiators 62 is a corrugated thin plate made of aluminum which is excellent in heat conduction and having a width equal to that of the PTC thermistor heaters 61.

In one unit 60*a* of the PTC thermistor heater device 60 consisting of these components, a plural number (in the illustrated example, 4) of the PTC thermistor heaters 61 are horizontally arranged, and electrically connected to each other and in thermal contact with each other to accomplish excellent heat conduction, by disposing two radiators 62 respectively on the both principal faces of the combination of the thermistor heaters so as to be connected with the electrodes of the PTC thermistor heaters 61. A first terminal 63 is disposed at one end of one of the radiators 62, and a second terminal 64 at one end of the other radiator 62. The radiators 62 are designed so as to have opposite polarities through the PTC thermistor heaters 61. The PTC thermistor heater device 60 is configured by connecting in parallel two sets of the units 60*a* each of which is one of the units constituting the PTC thermistor heater device to each other so that their first terminals 63 are brought in contact with each other back to back.

In the thus configured PTC thermistor heater device 60, when the first terminals 63 and the second terminals 64 are connected to a power source, the electrodes on the both principal faces of PTC thermistor heaters 61 are energized through the radiators 62 so that the PTC thermistor heaters 61 generate heat. The heat generated by the PTC thermistor heaters 61 is dissipated to the outside through the radiators 62, with the result that the PTC thermistor heater device 60 functions as a heater. When the first terminals 63 are used as a common terminal and the second terminals 64 are connected to a power source, the PTC thermistor heater device 60 generates heat of the maximum output level. When the first terminals 63 and one of the second terminals 64 are connected to the power source, the heat output can be reduced to a ½ of the maximum output level.

Japanese Patent Unexamined Publication No. Hei 4-251901 discloses a PTC thermistor heater device in which a single heating element formed by connecting a plurality of PTC thermistor heaters can change its output by itself. The PTC thermistor heater device is configured so that at least one of electrodes of the plurality of PTC thermistor heaters is provided with a plurality of power supply electrodes for selectively joining the plurality of PTC thermistor heaters, and electrical junctions of the power supply electrodes for the same PTC thermistor heater are prevented from overlapping with each other. The electrodes of the PTC thermistor heaters, and the power supply electrodes are suitably joined with each other by a conductive adhesive and an insulative adhesive. In the thus configured PTC thermistor heater device, the output can be changed by selecting power supply electrodes which are to be energized so as to increase or decrease the number of PTC thermistor heaters to be energized.

However, the conventional PTC thermistor heater device shown in FIG. 1 in which the output level can be switched has a problem in that the number of selectable levels of heat generation is restricted to two, that is, 100% or 50%.

In the device of Japanese Patent Unexamined Publication No. Hei 4-251901, the PTC thermistor heaters are connected to the electrode terminals by using a conductive adhesive and an insulative adhesive. Since the coefficient of thermal expansion of the PTC thermistor heaters is different from that of the power supply electrodes which are made of a metal, the thermal expansion difference between components due to heat cycle cannot be accommodated by the adhesives, thereby producing a problem in that the joining portions are peeled off. Since the temperature of the PTC thermistor heaters is elevated to a level as high as 200° C., moreover, there arises a further problem in that the adhesives are deteriorated because of the high temperature.

SUMMARY OF THE INVENTION

The invention has been developed in order to solve the above-discussed problems, and it is an object of the invention to provide a positive temperature coefficient thermistor heater and a positive temperature coefficient thermistor heater device which are safe to operate, which have a high degree of reliability, and which have an output switching function exhibiting a high degree of freedom in the switching range.

According to the invention, a positive temperature coefficient thermistor heater comprises: a positive temperature coefficient thermistor element; and electrodes respectively formed on both principal faces of said positive temperature coefficient thermistor element, wherein at least one of said electrodes consists of split electrodes which are separated from each other.

Also, according to the invention, a positive temperature coefficient thermistor heater device comprises: a positive temperature coefficient thermistor heater including a positive temperature coefficient thermistor element and electrodes respectively formed on both principal faces of said positive temperature coefficient thermistor element, at least one of said electrodes formed on both principal being comprised of split electrodes which are separated from each other; and radiator plates respectively disposed on both principal faces of said positive temperature coefficient thermistor heater.

Further, according to the invention, a positive temperature coefficient thermistor heater device comprises: a positive temperature coefficient thermistor heater having a positive temperature coefficient thermistor element and electrodes which are respectively formed on both principal faces of said positive temperature coefficient thermistor element; conductor terminals electrically connected to said electrodes; a first case which houses said positive temperature coefficient thermistor heater, said first case having a substantially U-like sectional shape; an insulator disposed on one of said electrodes of said positive temperature coefficient thermistor heater; a second case which houses said first case and said insulator, said second case having a substantially square frame section shape; and a radiator thermally connected to said second case; wherein at least one of said electrodes formed on said both principal faces of said positive temperature coefficient thermistor element is comprised of split electrodes which are separated from each other.

The split electrodes of the positive temperature coefficient thermistor heater may be equal or different in area to each other.

According to the invention, the PTC thermistor heater device is configured by using a PTC thermistor heater having split electrodes as specified in the above. Therefore, the output can arbitrarily be changed in accordance with the areas of the split electrodes by a simple structure which does not require an adhesive.

DETAILED DESCRIPTION OF THE PREFERRED EMBODIMENTS

Figure 1:
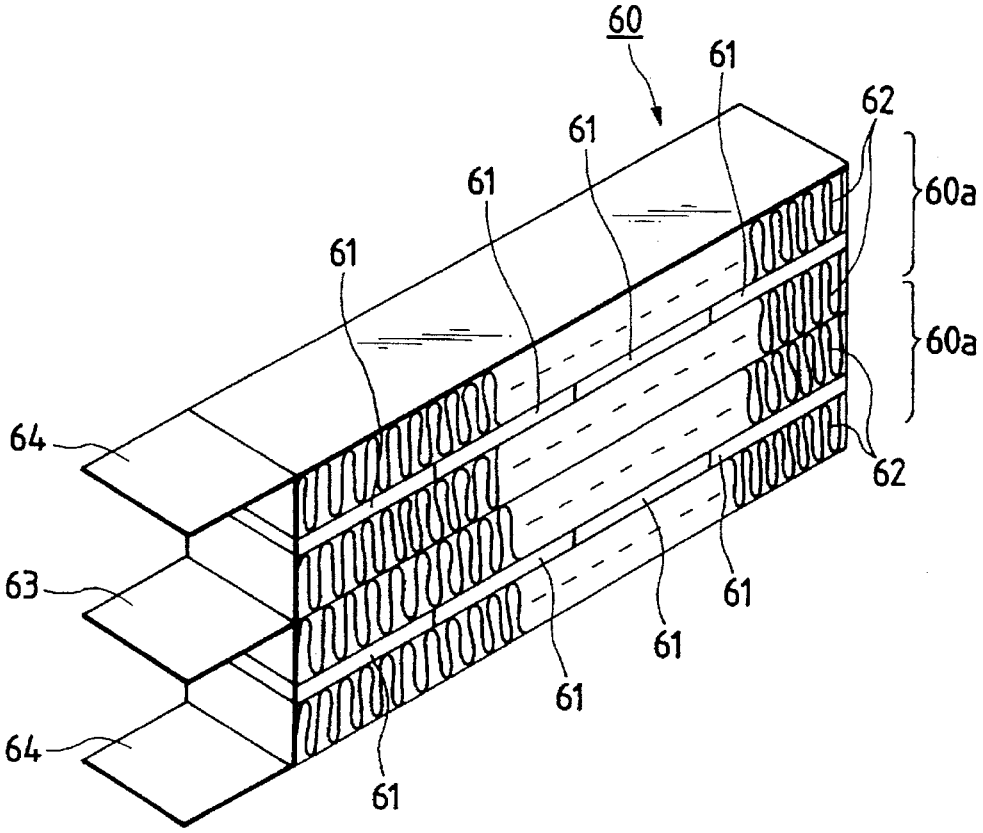
FIG. 1 PRIOR ART
FIG. 1 is a perspective view showing a conventional PTC thermistor heater device.
Figure 3:
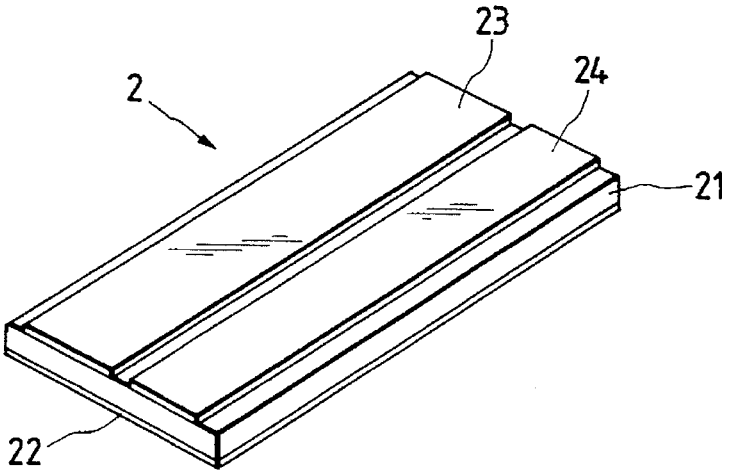
FIG. 3 is a perspective view showing a PTC thermistor heater according to a first embodiment of the invention.
Figure 2:
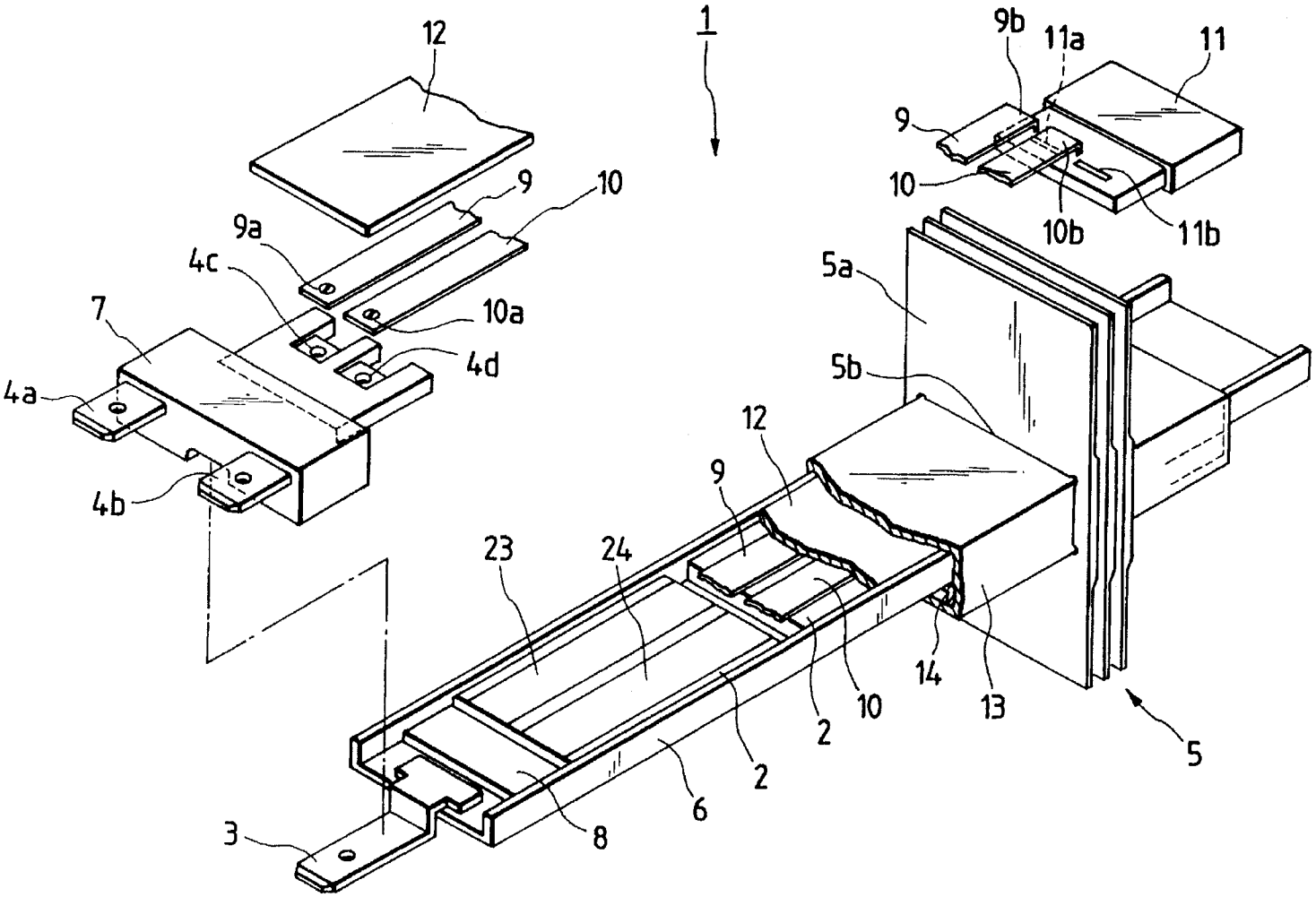
FIG. 2 is a partially exploded perspective view showing a PTC thermistor heater device according to an embodiment of the invention.

Hereinafter, a first embodiment of the PTC thermistor heater of the invention and an embodiment of the PTC thermistor heater device using the PTC thermistor heater will be described with reference to the accompanying FIGS. 2 and 3.

A PTC thermistor heater device 1 is mainly comprised of a plurality of PTC thermistor heaters 2, a first terminal 3 which is a conductor terminal, second terminals 4*a* and 4*b* which are other conductor terminals, and a radiator 5.

In each of the PTC thermistor heaters 2, a first electrode 22 is formed on one face of a substantially rectangular plate-like PTC thermistor element 21, and second electrodes 23 and 24 which are two strip-like split electrodes having the substantially same area are formed on the other face thereof being separated from each other at the center of the other face in the longitudinal direction. The second electrodes 23 and 24 are not formed in the vicinity of the lateral faces of the PTC thermistor element 21.

The PTC thermistor heater 2 thus configured is housed inside a first case 6 while directing the first electrode 22 downward. The first case 6 is made of, for example, aluminum which is excellent in heat conduction, and has a substantially U-like sectional shape. When a plurality of the PTC thermistor heaters 2 are used, for example, the heaters 2 are housed in the first case 6 in such a manner that the first electrodes 22 of all the heaters are directed downward and the lateral faces of the heaters 2 are aligned with each other. Thus, the plurality of PTC heaters 2 are connected in parallel to each other. A gap of a suitable size is formed in each of the left and right end portions of the first case 6 in the figure.

The first terminal 3 is made of a metal plate having an excellent conductivity and electrically and mechanically connected to the left end portion of the first case 6 in the figure, for example, by welding. The first terminal 3 makes electrical connection through the first case 6 with the first electrodes 22 of the PTC thermistor heaters 2.

A first holder 7 is made of insulative resin and integrated by molding with the second terminals 4*a* and 4*b* which are made of a metal plate having an excellent conductivity. Ends of the second terminals 4*a* and 4*b* in one side are exposed to the outside to function as external terminals, and the other ends 4*c* and 4*d* of the terminals are exposed from the first holder 7 to function as connecting portions which are to be respectively connected to the second electrodes 23 and 24. The first holder 7 is fitted into the left end portion of the case 6. In order to attain electrical insulation between the first case 6 and the other ends 4*c* and 4*d* of the second terminals 4*a* and 4*b* exposed from the first holder 7, a first insulating plate 8 made of, for example, alumina is interposed between the case 6 and the terminals 4*c*, 4*d*.

Power supply terminals 9 and 10 are made of a strip-like metal plate which is electrically conductive. Ends 9*a* and 10*a* of the power supply terminals 9 and 10 at one end are electrically connected to the other ends 4*c* and 4*d* of the second terminals 4*a* and 4*b* of the first holder 7 by, for example, welding, respectively. The other ends 9*b* and 10*b* of the power supply terminals 9 and 10 are inserted into, for example, square holes 11*a* and 11*b* formed in a second holder 11, to be fixed to the second holder 11. The power supply terminals 9 and 10 are brought into contact with the second electrodes 23 and 24 so as to accomplish the electrical connection between the terminals 9, 10 and the electrodes 23 24. As a result, the second terminals 4*a* and 4*b* are electrically connected to the second electrodes 23 and 24 through the power supply terminals 9 and 10, respectively.

The second holder 11 is made of an insulative resin and fitted onto the right end portion of the first case 6 so that the other ends 9*b* and 10*b* of the power supply terminals 9 and 10 are fixed.

A second insulating plate 12 is made of, for example, alumina and has a substantially rectangular shape. The second insulating plate 12 covers the upper sides of the power supply terminals 9 and 10 and is inserted into the first case 6, so that the power supply terminals 9 and 10 are insulated from the first case 6, and a second case 13.

The second case 13 is made of, for example, alumina which is excellent in heat conduction and has a substantially rectangular shape. The first case 6 which houses the PTC thermistor heaters 2, the first and second holders 7 and 11, the power supply terminals 9 and 10, and the first and second insulating plates 8 and 12 are housed inside the rectangular second case 13. For example, compression springs 14 are inserted into a gap formed between the first and second cases 6 and 13, so as to press the first case 6 upwardly against the ceiling portion of the rectangular second case 13, thereby fixing the first case 6.

A radiator plate 5*a* is made of, for example, a thin plate of alumina which is excellent in heat conduction and has a substantially rectangular outer shape. A rectangular through-hole 5*b* which has a shape substantially identical with the outer shape of the rectangular second case 13 is formed at the center portion of the radiator plate 5*a*.

The rectangular second case 13 is passed through the through-hole 5*b* of the radiator plate 5*a*, and a plurality of the radiator plates 5*a* are fixed to the second case 13 at substantially equal intervals, thereby constituting the radiator 5.

In the thus configured PTC thermistor heater device 1, when the first terminal 3 and the second terminals 4*a*, 4*b* are connected to a power source, the first electrodes 22 are energized through the first case 6 and also the second electrodes 23 and 24 are energized through the power supply terminals 9 and 10, with the result that the PTC thermistor heaters 2 generate heat of the maximum output level or produce an output of, for example, 1,200W. In contrast, when only one of the second terminals 4*a* and 4*b* is connected to the power source, a corresponding of the second electrodes 23 and 24 is energized through the power supply terminal 9 or 10. Since the second electrodes 23 and 24 have the substantially same area, the PTC thermistor heaters 2 generate heat of about ½ of the maximum output level or produce an output of, for example, 600W.

In the PTC thermistor heater device 1 described above, the side faces of the PTC thermistor heaters 2 are brought into contact with the first case 6 in a substantially direct manner. In order to attain electrical insulation between the first case 6 and the second electrodes 23 and 24, therefore, the second electrodes 23 and 24 are not formed in the vicinity of the long side end faces of each PTC thermistor element 21. However, the second electrodes 23 and 24 are not restricted to this configuration. In a structure in which a suitable insulator (not shown) is disposed between the side faces of the PTC thermistor heaters 2 and the first case 6, even when the second electrodes 23 and 24 are extended to the lateral faces of each PTC thermistor element 21, it is possible to attain electrical insulation between the first case 6 and the second electrodes 23 and 24.

Next, a second embodiment of the PTC thermistor heater in which the electrodes on both principal faces of each PTC thermistor element 21 are split to constitute split electrodes will be described.

Figure 4:
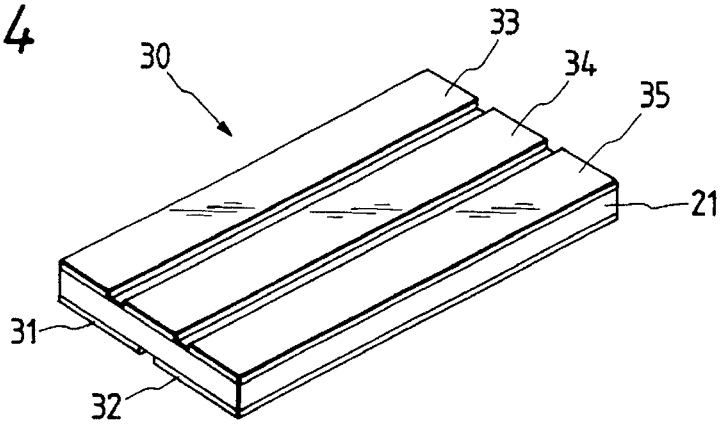
FIG. 4 is a perspective view showing a PTC termistor heater according to a second embodiment of the invention.

In FIG. 4, a PTC thermistor heater 30 is so configured that first electrodes 31 and 32 which are two strip-like split electrodes having the substantially same area are formed on one of the principal faces of the PTC thermistor element 21 and separated from each other at the center of the face in the long side direction, and second electrodes 33, 34 and 35 which are three strip-like split electrodes having the substantially same area are formed on the other face and separated from each other in the long side direction.

The thus configured PTC thermistor heater 30 is used as a heating element of a PTC thermistor heater device (not shown). In accordance with the ratio of areas of the electrodes opposing to each other, assuming that the total output attained when all the electrodes 31 to 35 are energized is indicated by a value of 1, when the first electrodes 31, 32 and the second electrodes 33 and 34 are energized, for example, the output of the PTC thermistor heater 30 is ⅔, when the first electrode 31 and the second electrodes 33, 34 are energized, the output of the PTC thermistor heater 30 is ½, and when the first electrode 31 and the second electrode 33 are energized, the output of the PTC thermistor heater 30 is ⅓. In other words, the output of the PTC thermistor heater 30 can suitably be increased or decreased by selecting electrodes to be energized.

The number of first and second terminals of the PTC thermistor heater device using the PTC thermistor heater 30 is required to be equal to that of the first and second electrodes.

In the PTC thermistor heaters 2 and 30 described above, the split electrodes formed on one of the principal faces are substantially equal in area to each other.

Next, a third embodiment in which split electrodes formed on one face are unequal in area to each other will be described.

Figure 5:
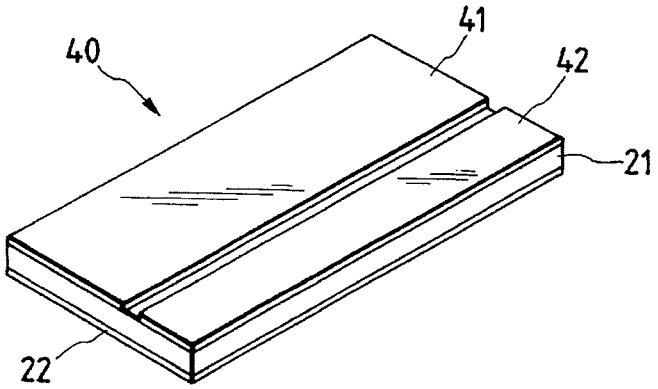
FIG. 5 is a perspective view showing a PTC thermistor heater according to a third embodiment of the invention.

In FIG. 5, a PTC thermistor heater 40 is so configured that the first electrode 22 is formed on the whole of one face of the PTC thermistor element 21, and second electrodes 41 and 42 which are strip-like split electrodes are formed on the other face and are separated from each other longitudinally so as to have an area ratio of about 2:1.

The thus configured PTC thermistor heater 40 is used as a heating element of a PTC thermistor heater device (not shown). In accordance with the ratio of areas of the electrodes opposing to each other, assuming that the total output attained when all the electrodes 22, 41 and 42 are energized is indicated by a value of 1, when the first electrode 22, and the second electrode 41 are energized, the output of the PTC thermistor heater 40 is ⅔, and when the first electrode 22 and the second electrode 42 are energized, the output of the PTC thermistor heater 40 is ⅓. In other words, the output of the PTC thermistor heater 40 can suitably be increased or decreased by selecting electrodes to be energized.

Next, a fourth embodiment in which split electrodes formed on the both faces are unequal in area to each other will be described.

Figure 6:
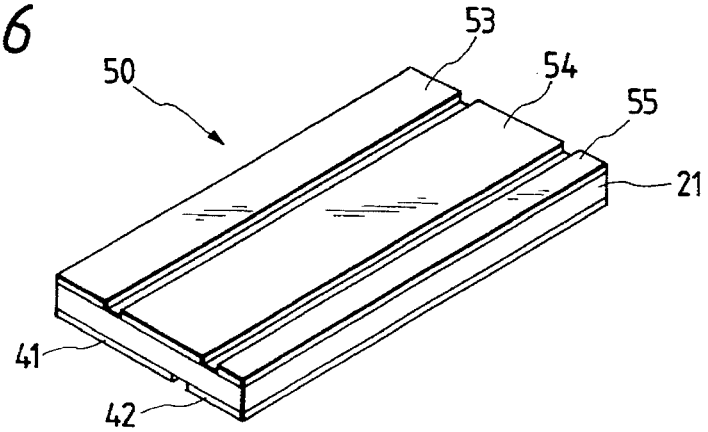
FIG. 6 is a perspective view showing a PTC thermistor heater according to a fourth embodiment of the invention.

In FIG. 6, a PTC thermistor heater 50 is so configured that first electrodes 53, 54 and 55 which are three split electrodes are separated longitudinally at two portions so as to have an area ratio of about 2 : 4 : 1 are formed on one of the principal faces of the PTC thermistor element 21, and the second electrodes 41 and 42 which are strip-like split electrodes are formed on the other face separated from each other longitudinally to have an area ratio of about 2 : 1 in the long.

The thus configured PTC thermistor heater 50 is used as a heating element of a PTC thermistor heater device (not shown). In accordance with the ratio of areas of the electrodes opposing to each other, assuming that the total output attained when all the electrodes 41, 42 and 53 to 55 are energized is indicated by a value of 1, when the first electrode 53, 54 and the second electrodes 41, 42 are energized, for example, the output of the PTC thermistor heater 50 is ⅚, and when the first electrode 55 and the second electrode 42 are energized, the output of the PTC thermistor heater 40 is ⅓. The description of the other cases is omitted. In other words, the output of the PTC thermistor heater 50 can finely be increased or decreased in a suitable manner to be a multiple of ⅙ or ⅓ by selecting electrodes to be energized.

In the electrode configuration of the PTC thermistor heater, the split number and ratio of the first and second electrodes are not restricted to the four embodiments described above. When the electrodes formed on one of the principal faces of the PTC thermistor element 21 are to be split, the split electrodes are formed at a split number and an area ratio which correspond with a desired output ratio of the PTC thermistor heater. For example, one of the principal faces of the PTC thermistor element 21 may be split at two portions to form an area ratio of about 2 : 2 : 1 or three split electrodes consisting of two electrodes having the same area and one electrode having a different area. Also on the other face, split electrodes may freely be formed at a split number and an area ratio which correspond with a desired output ratio. In this case, conductor terminals which are equal in number to the split electrodes are formed.

The PTC thermistor heater device 1 is not restricted to the embodiments described above. In accordance with the object, for example, the number of conductor supply terminals, the shape of the radiator, and the shapes of the first and second cases may be changed as desired as long as the same function is attained.

As described above, in the PTC thermistor heater of the invention, at least one of the electrodes formed on both principal faces of a PTC thermistor heater device are split. By selectively energizing the electrodes, therefore, the PTC thermistor heater is allowed to produce an output of a level corresponding with the area ratio of the split electrodes which can arbitrarily be set.

As a result, in a PTC thermistor heater device using the PTC thermistor heater of the invention, an output can be set with a high degree of freedom by setting the number of split electrodes and the area ratio.

Since the PTC thermistor heater device has a structure in which no adhesive is used, components of the PTC thermistor heater device are prevented from being deteriorated even when the temperature of the device is elevated, whereby the safety and reliability for a long term are enhanced.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A positive temperature coefficient thermistor heater device, comprising:

a positive temperature coefficient thermistor heater including a positive temperature coefficient thermistor element and electrodes formed on both of a pair of principal faces of said positive temperature coefficient thermistor element, at least one of said electrodes comprising split electrodes which are electrically separated from each other; and at least one radiator plate extending transversely away from at least one of a pair of principal faces of said positive temperature coefficient thermistor heater and structured and arranged for receiving and radiating heat from said positive temperature coefficient thermistor element.

2. A positive temperature coefficient thermistor heater device according to claim 1, wherein said split electrodes are equal in area to each other.

3. A positive temperature coefficient thermistor heater device according to claim 1, wherein at least two said split electrodes are different in area from each other.

4. A positive temperature coefficient thermistor heater device according to claim 1, wherein said at least one radiator plate comprises a plurality of radiator plates.

5. A positive temperature coefficient thermistor heater device according to claim 4, wherein said plurality of radiator plates extend transversely away from both said principal faces of said positive temperature coefficient thermistor heater.

6. A positive temperature coefficient thermistor heater device according to claim 1, wherein said at least one radiator plate faces of said positive temperature coefficient thermistor heater.

7. A positive temperature coefficient thermistor heater device, comprising:

a positive temperature coefficient (PTC) thermistor heater including a positive temperature coefficient (PTC) thermistor element and electrodes formed on both of a pair of principal faces of said positive temperature coefficient thermistor element, respectively;

conductor terminals electrically connected to said electrodes;

a first case which houses said positive temperature coefficient thermistor heater, said first case having a substantially U-like cross-sectional shape;

a second case which houses said first case, said second case having a substantially rectangular cross-sectional shape; and a radiator which is thermally connected to said second case and structured and arranged for receiving and radiating heat from said positive temperature coefficient thermistor element;

wherein at least one of said electrodes formed on said both principal faces of said positive temperature coefficient thermistor element comprises split electrodes which are electrically separated from each other.

8. A positive temperature coefficient thermistor heater device according to claim 7, wherein said split electrodes are equal in area to each other.

9. A positive temperature coefficient thermistor heater device according to claim 7, wherein at least two said split electrodes are different in area from each other.

10. A positive temperature coefficient thermistor heater device according to claim 7, wherein said radiator comprises at least one radiator plate extending transversely away from at least one of a pair of principal faces of said PTC thermistor heater.

11. A positive temperature coefficient thermistor heater device according to claim 10, wherein said at least one radiator plate comprises a plurality of radiator plates.

12. positive temperature coefficient thermistor heater device according to claim 11, wherein said plurality of radiator plates extend transversely away from both said principal faces of said positive temperature coefficient thermistor heater.

13. A positive temperature coefficient thermistor heater device according to claim 10, wherein said at least one radiator plate extends transversely away from both said principal faces of said positive temperature coefficient thermistor heater.

14. A positive temperature coefficient thermistor heater device according to claim 7, further comprising a holder integrated with said conductor terminals, said holder being attachable to an end of said first and second cases.

15. A positive temperature coefficient thermistor heater device according to claim 14, further comprising power supply terminals respectively connected to said conductor terminals and being electrically connected to respective ones of said electrodes.

16. A positive temperature coefficient thermistor heater device, comprising:

a positive temperature coefficient (PTC) thermistor heater including a positive temperature coefficient (PTC) thermistor element and electrodes formed on both of a pair of principal faces of said positive temperature coefficient thermistor element, respectively;

conductor terminals electrically connected to said electrodes;

a radiator which is thermally connected to said second case and structured and arranged for receiving and radiating heat from said positive temperature coefficient thermistor element;

wherein at least one of said electrodes formed on said both principal faces of said positive temperature coefficient thermistor element comprises split electrodes which are electrically separated from each other.

17. A positive temperature coefficient thermistor heater according to claim 16, wherein said split electrodes are equal in area to each other.

18. A positive temperature coefficient thermistor heater according to claim 16, wherein at least two said split electrodes are different in area from each other.

19. A positive temperature coefficient thermistor heater device according to claim 16, wherein said radiator comprises at least one radiator plate extending transversely away from at least one of a pair of principal faces of said PTC thermistor heater.

20. A positive temperature coefficient thermistor heater device according to claim 19, wherein said at least one radiator plate comprises a plurality of radiator plates.

21. A positive temperature coefficient thermistor heater device according to claim 20 wherein said plurality of radiator plates extend transversely away from both said principal faces of said positive temperature coefficient thermistor heater.

22. A positive temperature coefficient thermistor heater device according to claim 21, wherein said at least one radiator plate extends transversely away from both said principal faces of said positive temperature coefficient thermistor heater.

23. A positive temperature coefficient thermistor heater device according to claim 16, further comprising a holder integrated with said conductor terminals, said holder being attachable to an end of said first and second cases.

24. A positive temperature coefficient thermistor heater device according to claim 23, further comprising power supply terminals respectively connected to said conductor terminals and being electrically connected to respective ones of said electrodes.

25. A positive temperature coefficient thermistor heater device, comprising:

a positive temperature coefficient (PTC) thermistor heater including a positive temperature coefficient (PTC) thermistor element and electrodes formed on both of a pair of principal faces of said positive temperature coefficient thermistor element, respectively;

conductor terminals electrically connected to said electrodes;

a first case which houses said positive temperature coefficient thermistor heater, said first case having a substantially U-like cross-sectional shape; and a second case which houses said first case, said second case having a substantially rectangular cross-sectional shape;

wherein at least one of said electrodes formed on said both principal faces of said positive temperature coefficient thermistor element comprises split electrodes which are electrically separated from each other.

26. A positive temperature coefficient thermistor heater device according to claim 25, further comprising a holder integrated with said conductor terminals, said holder being attachable to an end of said first and second cases.

27. A positive temperature coefficient thermistor heater device according to claim 25, further comprising power supply terminals respectively connected to said conductor terminals and being electrically connected to respective ones of said electrodes.

28. A positive temperature coefficient thermistor heater device, comprising:

a positive temperature coefficient (PTC) thermistor heater including a positive temperature coefficient (PTC) thermistor element and electrodes formed on both of a pair of principal faces of said positive temperature coefficient thermistor element, respectively; and conductor terminals electrically connected to said electrodes;

wherein at least one of said electrodes formed on said both principal faces of said positive temperature coefficient thermistor element comprises split electrodes which are electrically separated from each other.

29. A positive temperature coefficient thermistor heater device according to claim 28, further comprising a holder integrated with said conductor terminals, said holder being attachable to an end of said first and second cases.

30. A positive temperature coefficient thermistor heater device according to claim 29, further comprising power supply terminals respectively connected to said conductor terminals and being electrically connected to respective ones of said electrodes.

* * * * *